US012569071B2

(12) United States Patent
Delorme et al.

(10) Patent No.: US 12,569,071 B2
(45) Date of Patent: Mar. 10, 2026

(54) FOLDABLE DECKCHAIR FOR A CHILD

(71) Applicants: BEABA, Bellignat (FR); CHILDHOME B.V, Kontich (BE)

(72) Inventors: Fabrice Delorme, Ambronay (FR); Vincent Vanderjonckheijd, Geel (BE)

(73) Assignees: BEABA, Bellignat (FR); CHILDHOME B.V, Kontich (BE)

( * ) Notice: Subject to any disclaimer, the term of this patent is extended or adjusted under 35 U.S.C. 154(b) by 92 days.

(21) Appl. No.: 18/536,700

(22) Filed: Dec. 12, 2023

(65) Prior Publication Data

US 2024/0197081 A1 Jun. 20, 2024

(51) Int. Cl.
*A47D 1/02* (2006.01)
*A47D 13/10* (2006.01)

(52) U.S. Cl.
CPC ..... *A47D 1/02* (2013.01); *A47D 13/101* (2022.08)

(58) Field of Classification Search
CPC .... A47D 13/10; A47D 13/107; A47D 13/101; A47D 1/02
USPC ..... 297/DIG. 11
See application file for complete search history.

(56) References Cited

U.S. PATENT DOCUMENTS 5,507,564 A * 4/1996 Huang ..... A47D 1/002 297/256.13
5,509,721 A * 4/1996 Huang ..... A47D 1/02 297/188.1
7,779,490 B2 * 8/2010 Bergkvist ..... A47D 1/002 297/DIG. 11
2016/0157633 A1 6/2016 Aboukrat et al.
2022/0257029 A1 * 8/2022 Nevins ..... A47D 13/107

FOREIGN PATENT DOCUMENTS

CN 203693087 U 7/2014
CN 213488033 U 6/2021
DE 202014101886 U1 * 6/2014 ..... A47D 13/102
GB 2507530 A * 5/2014 ..... A47D 13/107

OTHER PUBLICATIONS

French Search Report for French Application No. FR2213316, dated Jun. 15, 2023, 6 pages.

* cited by examiner

*Primary Examiner* — Milton Nelson, Jr.
(74) *Attorney, Agent, or Firm* — Dickinson Wright PLLC

(57) ABSTRACT

The disclosure relates to a foldable deckchair for a child comprising a frame, a seat structure configured to carry a flexible element for receiving a child, and a connecting mechanism for a connection between the frame and the seat structure. According to the disclosure, the connecting mechanism comprises a drive shaft which extends along a longitudinal axis between two ends connected to two uprights of the seat structure, and a central casing, attached to the frame, which is passed through on either side by the drive shaft along the longitudinal axis, and in that the deckchair comprises a locking device which is housed in the central casing and which comprises a first element secured in terms of movement to the drive shaft and a second element movable between a locked position in which the first element is locked and a un locked position in which the first element is unlocked.

12 Claims, 5 Drawing Sheets

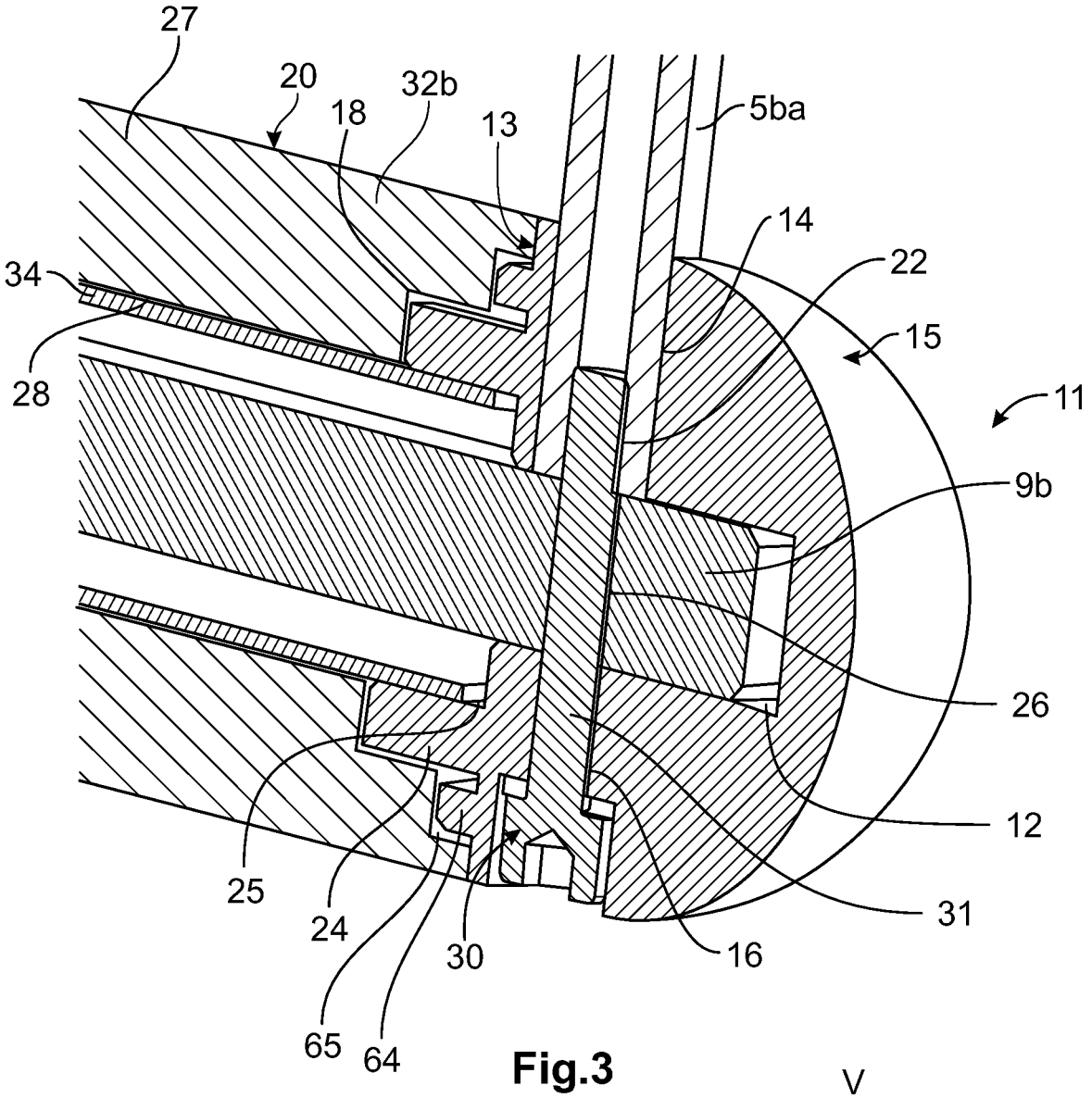
Fig.3
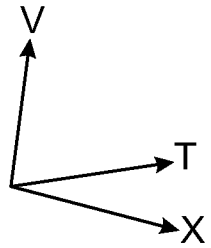

FOLDABLE DECKCHAIR FOR A CHILD

CROSS REFERENCE TO RELATED APPLICATION

This patent application claims the benefit and priority of French Patent Application No. 2213316, filed on Dec. 14, 2022, the disclosure of which is incorporated by reference herein in its entirety as part of the present application.

TECHNICAL FIELD

This disclosure relates to the field of childcare. In particular, it is aimed at a folding deckchair or hammock for children.

TECHNICAL BACKGROUND

Generally speaking, a deckchair or hammock for children comprises a flexible element, such as a cloth, attached to a stationary frame resting on the ground. This deckchair is intended for children aged from 0 to around 9 months and can be placed in a reclining or slightly inclined position. This type of deckchair is very bulky, especially when it comes to finding somewhere to store them after use.

There are now referred to as folding deckchairs to overcome this problem of overall dimension. The foldable deckchairs comprise a connecting mechanism to allow them to be folded. Examples of such a deckchair are described in the documents CN-U-203693087, US-A1-2016/157633, and CN-U-213488033. However, the connecting mechanisms comprise a number of parts that make it difficult to implement and fold the deckchairs. In addition, these connecting mechanisms cooperate with locking devices which are not easy to use, particularly because of the demanding safety standards relating to handling. These standards can affect the ease of use of the product: poor accessibility, which may mean that the user has to bend down to reach the connecting mechanism and/or the locking device, complex handling, etc.

SUMMARY

The aim of the present disclosure is to provide a simple solution allowing to facilitate the folding of a deckchair for child while being economical in terms of manufacturing cost.

This is achieved in accordance with the disclosure by a foldable deckchair for a child comprising a frame configured to rest on a support surface, a seat structure configured to carry a flexible element for receiving a child, and a connecting mechanism for a connection between the frame and the seat structure which is configured to allow at least the movement of the frame relative to the seat structure, the connecting mechanism comprising a drive shaft which extends along a longitudinal axis between a first end and a second end, and which is connected to two uprights of the seat structure at the level of the first and second ends, and a central casing, attached to the frame, which is passed through on either side by the drive shaft along the longitudinal axis, the deckchair comprising a locking device which is housed in the central casing and which comprises a first element secured in terms of movement to the drive shaft and a second element movable between a locking position in which the first element is locked and a unlocking position in which the first element is unlocked.

Thus, this solution allows to achieve the above-mentioned objective. In particular, such a drive shaft allows to make a connection between the frame and the seat structure as well as the locking device. The latter is also simple to implement and has a low number of parts (there is just one locking device), allowing to lock the deckchair in the desired position effectively and reliably. This configuration is also extremely compact and intuitive to use.

The deckchair also comprises one or more of the following characteristics, taken alone or in combination:

- the deckchair comprises a sleeve enveloping the drive shaft and extending on either side of the central casing along the longitudinal axis.
- the deckchair comprises a protective sheath which is installed in the sleeve and around the drive shaft.
- the first element is centred on the longitudinal axis and is provided with first teeth at least on a segment of its periphery, the second element being movable about an axis parallel to the longitudinal axis and comprising at least one second tooth configured to engage with one of the first teeth.
- a return element is arranged in the central housing and so as to exert a return force on the second element movable towards the first element.
- the sleeve comprises a first portion and a second portion which are separated by the central casing along the longitudinal axis, the central casing comprising a bore opening into a central bore of the sleeve.
- the central casing comprises a connecting segment which comprises the bore, the connecting segment having an external surface with a surface continuity with an external surface of the sleeve.
- a connecting element is mounted, on the one hand, at each free end of an upright of the seat structure and, on the other hand, at each distal end of the first portion of the sleeve and of the second portion of the sleeve, each connecting element comprising a blind hole receiving the first and second ends of the drive shaft respectively.
- the deckchair comprises control elements configured to control the locking or unlocking of the locking device.
- the control elements are arranged to cause the second element to move between the locking position and the unlocking position.
- one of the first element and second element comprising at least one tooth configured to be housed in a corresponding slot of the other of the first element and second element so as to lock the drive shaft in displacement.
- the central casing comprises a connecting segment at least partly surrounding a median portion of the drive shaft.
- the central casing comprises a connecting segment formed in one piece with a sleeve enveloping the drive shaft.
- the first element of the locking device is arranged in a median portion of the central casing.
- the locking device passes through at least partly of both sides of the drive shaft.
- the second element is configured to allow or prevent the movement of the first element.
- the locking device is housed in the central casing and at the level of a median plane of the deckchair parallel to a direction of elongation of the deckchair.

BRIEF DESCRIPTION OF THE FIGURES

The disclosure will be better understood, and other purposes, details, characteristics and advantages thereof will become clearer upon reading the following detailed explanatory description of embodiments given as purely illustrative and non-limiting examples, with reference to the appended schematic drawings in which:

FIG. 3 is a detail view and axial cross-section of a connecting element cooperating with a member of a connecting mechanism according to a different embodiment;

DETAILED DESCRIPTION

Figure 1:
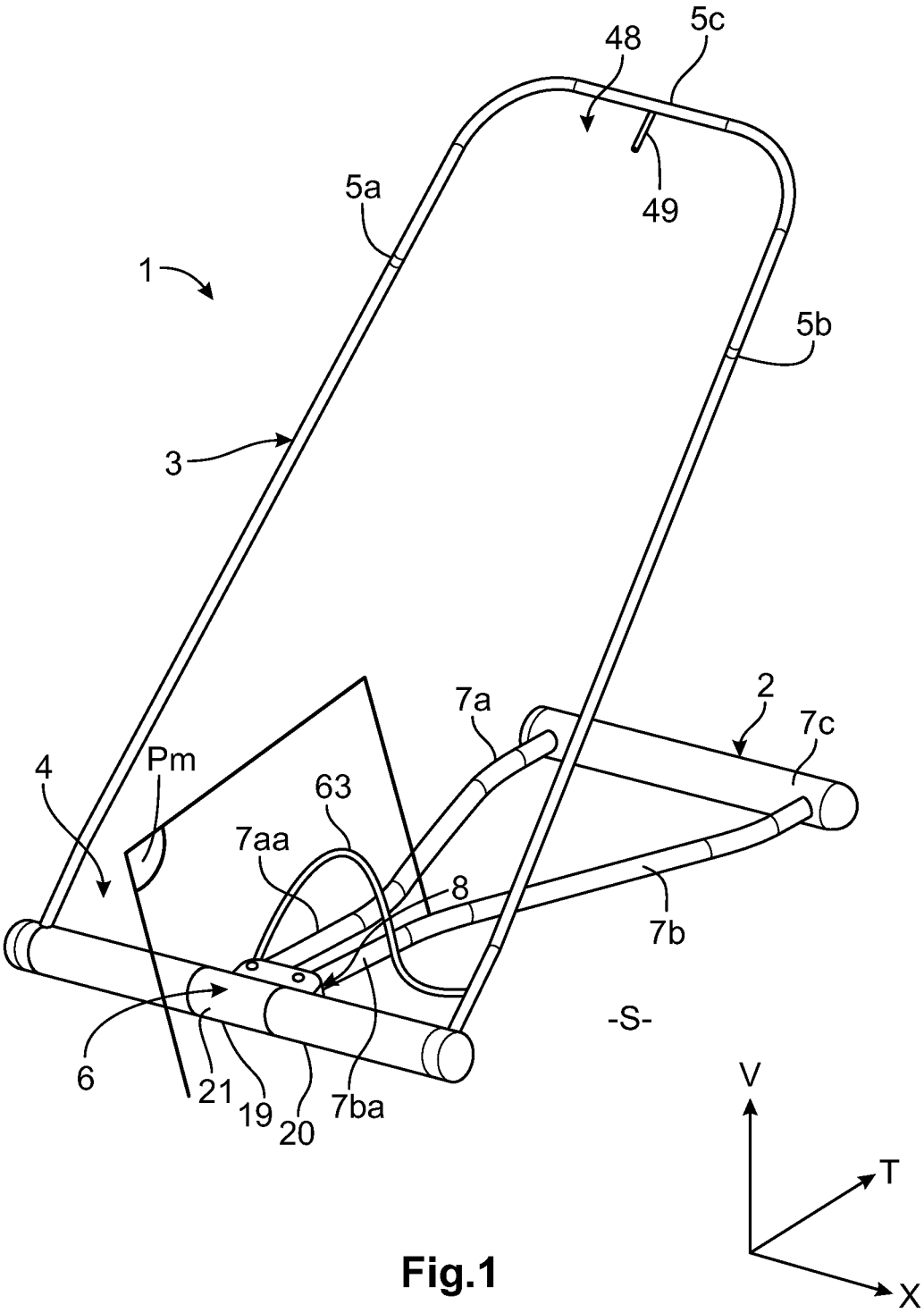
FIG. 1 is a perspective view of an example of a foldable deckchair without a flexible element according to the a particular embodiment.

FIG. 1 illustrates a folding deckchair 1 for child such as children aged from 0 to 9 months (or until the child at least tries to stand up on its own) or weighing up to 15 kg. The deckchair allows the child to be reclined or inclined slightly so that they can rest or interact with their environment.

The deckchair 1 comprises a frame 2 configured to rest on a support surface S and a seat structure 3 configured to carry a flexible element (not shown) which allow to hold the child. The deckchair 1 also comprises a connecting mechanism 4 for a connection between the frame 2 and the seat structure 3. The connecting mechanism 4 is configured to allow at least the seat structure 3 to move relative with respect to the frame 2.

In the present description, the flexible element can be a cloth, a cushion or a thin foam (for example between 2 and 100 mm) covered with a cloth. The flexible element is flexible enough to allow the child to be placed safely and comfortably, and can also be adapted to the shape of the child. Accessories such as a harness, wedge head restraint or shoulder protector can be added for more comfort and safety to the child in the flexible element. The harness is attached to the flexible element to allow to keep the child safe. The harness can be a three-point or five-point harness. The shoulder protector or wedge head can be attached to the flexible element or fitted to it. A reducer can also be provided to adapt the flexible element to the morphology of a newborn baby.

In this example, the seat structure 3 comprises two uprights 5*a*, 5*b* which are substantially parallel to each other. Advantageously, but without limitation, the seat structure 3 is generally U-shaped with two uprights 5*a*, 5*b* and a longitudinal bar 5*c*. The longitudinal bar 5*c* extends along a longitudinal axis X. This U-shape makes it easier to manufacture and assemble the various portions of the deckchair 1. The uprights 5*a*, 5*b* can be inclined with respect to a straight line which is perpendicular to the longitudinal axis X and which is contained in the plane of the uprights 5*a*, 5*b*. The inclination can be between 5° and 10°. Alternatively, the seat structure 3 comprises the two uprights 5*a*, 5*b* and the longitudinal bar 5*c* is fitted to connect the two uprights 5*a*, 5*b*.

The flexible element is generally attached to at least the uprights 5*a*, 5*b* and to the bar 5*c*. The attachment can be permanent or removable. Advantageously, the flexible element is removably attached to facilitate its removal and its maintenance. These can be attached with press studs, Velcro® strips, etc.

The connecting mechanism 4 comprises a central casing 6. Advantageously, the central casing 6 is arranged in a median plane PM parallel to the main direction of elongation of the deckchair. The longitudinal axis X is perpendicular to the main direction of elongation of the deckchair 1. In other words, the longitudinal axis is perpendicular to the median plane.

Advantageously, the frame 2 comprises two arms 7*a*, 7*b* which are attached to the central casing 6. Each arm 7*a*, 7*b* comprises a first end 7*aa*, 7*ba* which is attached to the central casing 6. The first ends 7*aa*, 7*ba* are parallel to each other in the example shown in FIG. 1. Advantageously, the first ends 7*aa*, 7*ba* also extend parallel to the median plane PM. In other words, the arms 7*a*, 7*b* extend from the central casing 6 along a first transverse axis T.

The first transverse axis Tis perpendicular to the longitudinal axis X and to a second transverse axis V.

Also in FIG. 1, advantageously but not restrictively, the central casing 6 comprises a receiving face 8, defined in a plane perpendicular to the first transverse axis T, and the arms 7*a*, 7*b* extend from this receiving face. The receiving face 8 comprises two orifices (not shown) with axes parallel to the first transverse axis T and which open out inside the central casing. The latter comprises two receiving housings (not shown) designed to receive at least a portion of the first ends 7*aa*, 7*ba*. Each orifice faces a housing and opens into it. Each housing extends along the first transverse axis T.

Advantageously, the central casing 6 is formed by a first casing portion 6*a* and a second casing portion 6*b*. The second casing portion 6*b* comprises the two housings for receiving the first ends 7*aa*, 7*ba* to hold them more securely in position. Of course, the central casing 6 could comprise a single housing. The first casing portion 6*a* overlaps the second casing portion 6*b* with the first and second ends.

Figure 2:
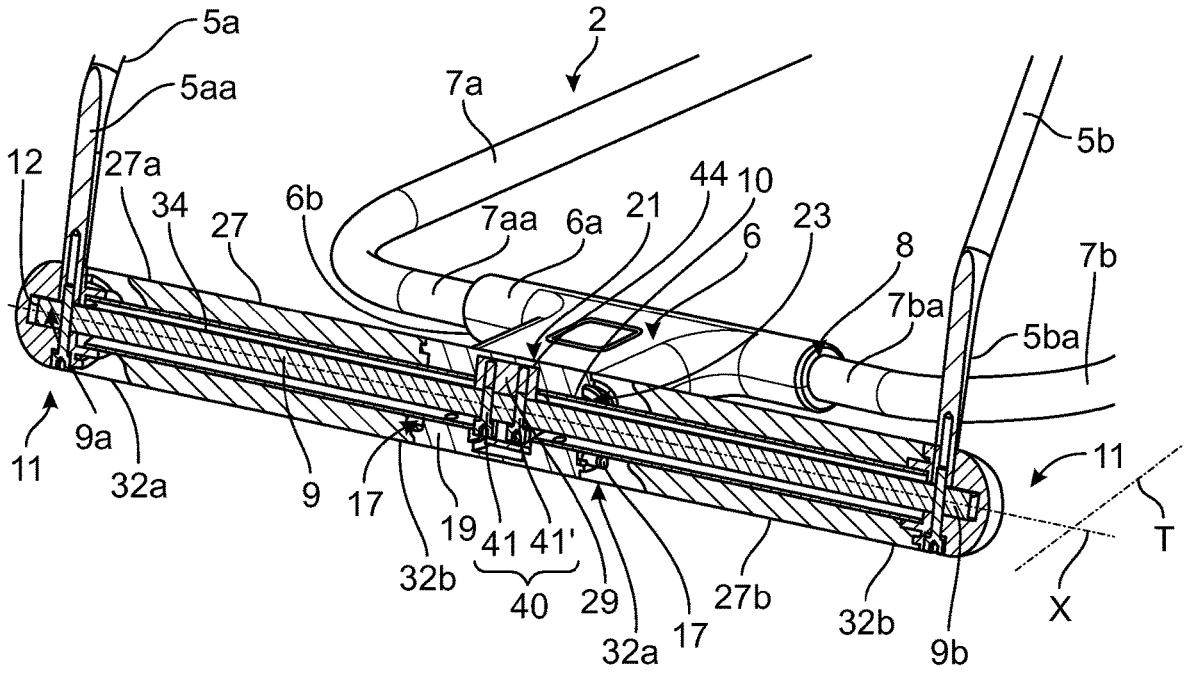
FIG. 2 is a perspective view and longitudinal cross-section of a connecting mechanism of an example of a foldable deckchair according to a given embodiment.

According to a variant embodiment illustrated in FIG. 2, the first ends 7*aa*, 7*ba* extend along an axis parallel to the longitudinal axis X and each from the receiving face 8 which is this time defined in a plane perpendicular to the longitudinal axis X. The central casing 6 comprises at least one housing (not shown) in which the first ends 7*aa*, 7*ba* are housed. The housing extends along an axis parallel to the longitudinal axis X. Advantageously, but without limitation, the housing is formed by the first casing portion 6*a* and the second casing portion 6*b*.

In the present embodiment, the frame 2 also comprises a crossbar 7*c* which is connected to the two arms 7*a*, 7*b*. The crossbar 7*c* and the two arms 7*a*, 7*b* are configured to rest stably on the support surface S, such as the ground, as shown in FIG. 1.

The arms 7*a*, 7*b* and the crossbar 7*c* are generally triangular in shape as shown in FIG. 1. The crossbar 7*c* extends along the longitudinal axis X. Of course, the arms 7*a*, 7*b* and the crossbar 7*c* can be generally U-shaped. The crossbar 7*c* is integral with the arms. Alternatively, the crossbar 7*c* can be fitted and attached to the arms 7*a*, 7*b*.

The arms 7*a*, 7*b* and the crossbar 7*c* can be made of a metallic and/or wood material. The metallic material can be aluminium or steel. These can be lacquered. The elements of the seat structure 3 can be made of a metallic or wood material.

The connecting mechanism 4 is configured so that the deckchair 1 occupies or moves between at least a first position and a second position. In the first position, the arms 7*a*, 7*b* of the frame 2 and the uprights 5*a*, 5*b* of the seat structure 3 extend in planes that are substantially parallel (+ or −5°). These planes are perpendicular to the median plane PM. In the second position, the uprights 5*a*, 5*b* extend in a plane transverse with respect to the plane in which the arms 7*a*, 7*b* of the frame are defined. In other words, the seat structure 3 is at a distance from the frame 2 in the second position. The deckchair 1 can occupy one or more intermediate positions between the first and the second positions. The opening angle between the first position and the second position can be between 20° and 55°.

In normal use, when the deckchair can accommodate a child, the deckchair 1 occupies the second position with the arms 7*a*, 7*b* resting on the support surface S and the uprights 5*a*, 5*b* at a distance from the arms 7*a*, 7*b*. The longitudinal axis X and the first transverse axis T are in this case parallel to the support surface. The arms 7*a*, 7*b* are inclined to the plane XT.

With reference to FIG. 2, the connecting mechanism 4 comprises a drive shaft 9 which extends along the longitudinal axis X. The drive shaft 9 is connected to the uprights 5*a*, 5*b* of the seat structure 3. Advantageously, the drive shaft 9 extends between a first end 9*a* and a second end 9*b* along the longitudinal axis X. The first end 9*a* and the second end 9*b* of the drive shaft 9 are connected to the uprights 5*a*, 5*b*.

The movement of the seat structure 3 relative to the frame 2 is a rotation about the longitudinal axis X. The drive shaft 9 allows the rotation to take place.

The central casing 6 comprises a bore 10 which passes through it on both sides along the longitudinal axis X. Here, the central casing 6 is arranged in a central area of the drive shaft 9 in relation to the length of the drive shaft 9. The drive shaft 9 passes through the bore 10 of the central casing 6. We understand that the median plane PM of the central casing 6 is perpendicular to the longitudinal axis. In this way, the seat structure 3 can pivot relative to the frame 2 thanks to the drive shaft 9, which rotates inside the bore 10 in the frame 2.

Advantageously, but not exclusively, the drive shaft 9 provides a flexible connection between the frame 2 and the seat structure 3. The flexibility can be defined by the small cross-section of the drive shaft 9. The rotational forces generate a torque on the drive shaft 9, which in this case acts as a torque damper. The drive shaft 9 can have a section of between 25 $mm^2$ and 400 $mm^2$. This section allows an elastic deformation of the drive shaft 9 when a predetermined weight is applied to the deckchair.

The drive shaft 9 has a rectangular cross-section. Of course, the drive shaft 9 could have a circular or other cross-section.

Alternatively, the drive shaft 9 is rigid. In this case, when a determined weight is applied to the deckchair 1, the uprights 5*a*, 5*b* of the seat structure 3 will deform rather than the drive shaft 9.

Referring to FIG. 3, a connecting element 11 is mounted towards a free end 5*aa*, 5*ba* of each upright 5*a*, 5*b*. The connecting element 11 allows to connect the drive shaft 9 to the uprights 5*a*, 5*b*. The connecting element 11 is in the form of a plug or an end cap. To this end, each connecting element 11 advantageously comprises a blind hole 12 which opens onto a lateral surface 13 thereof. The lateral surface 13 is defined in a plane perpendicular to the longitudinal axis X. The blind hole 12 has an axis coaxial with the longitudinal axis X.

The blind hole 12 of each connecting element 11 receives one of the first and second ends 9*a*, 9*b* respectively of the drive shaft 9. The blind hole 12 ensures the transmission of the torque to the drive shaft 9 via the interface with the uprights 5*a* and 5*b*. Advantageously, each blind hole 12 has a shape corresponding to that of the drive shaft (or at least to the first and second ends 9*a*, 9*b* of the drive shaft 9).

Each connecting element 11 can be fitted and attached to each free end 5*aa*, 5*ba* of an upright 5*a*, 5*b*. Alternatively, each connecting element 11 is integral (formed in one piece) with an upright 5*a*, 5*b*.

In the present example, the connecting element 11 is fitted and the connection element 11 is attached to an upright by means of threaded members. Other attachment means, such as welding or other suitable means, are also possible.

According to one example of embodiment, each connecting element 11 comprises, for example, a first orifice 14 in which the free end 5*aa*, 5*ba* of an upright 5*a*, 5*b* is received. The first orifice 14 opens into the blind hole 12 and also onto an external surface 15 of the connecting element 11. The first orifice 14 extends in a direction perpendicular to the longitudinal axis X.

In this case, the free end 5*aa*, 5*ba* of each upright 5*a*, 5*b* can be connected to the connecting element 11 or to the drive shaft 9. As can be seen in FIG. 3, the connecting element 11 also comprises a second orifice 16 which opens into the blind hole 12 on the one hand and onto the external surface 15 of the latter on the other. The first orifice 14 is advantageously coaxial with the second orifice 16. Attachment members 30 are received in each first orifice 14 so as to carry out the attachment of an upright 5*a*, 5*b* to the connecting element 11. The attachment members 30 comprise a screw 31. Advantageously, but in a non-limiting manner, each free end 5*aa*, 5*ba* comprises a threaded hole 22 designed to receive the threaded portion of the screw 31.

Advantageously, the drive shaft 9 comprises slots 26 passing transversely through it on either side. Each slot 26 is arranged at (towards) one end 9*a*, 9*b* of the drive shaft 9. Each slot 26 is (when installed) opposite the first and second orifices 14, 16. Each screw 31 also passes through a corresponding slot 26. In other words, the attachment member 30 attaches together the connecting element 11, the drive shaft 9 and the corresponding upright 5*a*, 5*b*.

In this way, the connecting elements 11 provide the mechanical connection between the seat structure 3 and the drive shaft 9.

With reference to FIGS. 2 and 3, the deckchair 1 advantageously comprises, but is not limited to, a sleeve 27 enveloping the drive shaft 9. This allows to protect the drive shaft 9 from the external environment. In other words, the sleeve 27 comprises a central bore 28 with an axis coaxial with the longitudinal axis. The bore 10 of the central casing 6 opens into the central bore 28 of the sleeve 27. The drive shaft 9 passes through this central bore 28 and through the bore 10 of the central casing 6. The central bore 28 opens out at each end of the sleeve 27.

In this example of embodiment, the sleeve 27 extends on either side of the central casing 6. In other words, the sleeve 27 consists of a first portion 27*a* and a second portion 27*b*. The first portion 27*a* and the second portion 27*b* are separated by the central casing 6. The central casing 6 and the sleeve 27 are also distinct. This allows to facilitate the manufacture and the assembly of the central casing 6 and the deckchair 1. The sleeve 27 made in two portions also allows to facilitate the maintenance and to repair it. In addition, the fact that the sleeve 27 is in two portions means that it is more economical, lighter and more aesthetically pleasing.

Advantageously, the sleeve 27 is made of a metallic or wood material. The metallic material can be steel or aluminium.

Advantageously, the central casing 6 comprises at least one connecting segment 19 having at least one cross-section similar to that of the sleeve 27. Advantageously, the connecting segment surrounds at least a median portion of the drive shaft along the longitudinal axis. Here, the sleeve 27 has a cylindrical shape with a circular cross-section. The connecting segment 19 comprises a cylindrical shape with a circular cross-section. Of course, the sleeve 27 could have a rectangular shape, as could the connecting segment 19.

Advantageously, the sleeve 27 has an external surface 20 with a surface continuity with the external surface 21 of the connecting segment 19. This allows to avoid snags with the support surface, a fabric or other material.

Each first portion 27*a* and second portion 27*b* of the sleeve 27 comprises a proximal end 32*a* and a distal end 32*b*. The proximal and distal ends are opposite each other 32*a*, 32*b* along the longitudinal axis (when installed). Each proximal end 32*a* is coupled to a lateral flank 23 of the connecting segment 19. A connecting element 11 is mounted at each distal end 32*b* of the first and second portions of the sleeve 27. To achieve this, each connecting element 11 comprises a first boss 24 which engages in a first counterbore 18 of the first and second portions of the sleeve 27. Each first counterbore 18 is provided in the sleeve 27 and has a wall abutting a bearing surface formed by the first boss 24. Each first boss 24 extends from the lateral surface 13 of the connecting element 11. Here, the first boss 24 is cylindrical with a circular cross-section and is centred on the longitudinal axis X. The first counterbore opens into the central bore 28. This allows to hold and centre the connecting element 11 in position on the sleeve.

The first boss 24 delimits an undercut 25 which opens into the blind hole 12. The undercut 25 is coaxial with the blind hole 12. Advantageously, but without limitation, the undercut 25 has an internal dimension (here an internal diameter) which is greater than the internal dimension (height, width or diameter) of the blind hole 12.

In the example shown, each connecting element 11 also comprises a second boss 64 which engages in a second counterbore 65 provided at each distal end of the sleeve 27 so as to hold and centre the connecting element 11 on the sleeve 27. The second boss is arranged around the first boss. Advantageously, the second counterbore 65 opens into the central bore 28 and is coaxial with the first counterbore 18. The second counterbore 65 has a larger internal diameter than the first counterbore 18. Of course, the connecting element 11 can comprise a single boss.

The bore portions (of the central bore 28) of the first and second sleeve portions 27 open at the distal ends 32*b*.

Advantageously, the sleeve 27 is prevented from rotating with respect to the longitudinal axis X. The sleeve 27 can be prevented from rotating by means of an anti-rotation pin 17 extending between the central casing 6 and the first and second portions 27*a*, 27*b* of the sleeve 27. The anti-rotation pin 17 can be seen in a cutaway portion in FIG. 2. The anti-rotation pin 17 can be fitted or formed in one piece with the central casing 6 or the sleeve 27. In the case of the fitted anti-rotation pin 17, the central casing 6 comprises notches (not shown) opening onto the lateral flanks 23 of the central casing 6 along the longitudinal axis. The proximal ends 32*a* comprise notches (not shown) that complement the notches in the central casing 6. The notches and additional notches are fitted with the anti-rotation pins 17. Alternatively, as shown in FIG. 2, each lateral flank 23 is provided with at least one anti-rotation pin 17 which projects along the longitudinal axis X and is received in a notch arranged at the proximal end 32*a*. In other words, the anti-rotation pin 17 is made of the same material as the central casing 6. This allows to prevent the parasitic movements of the first and second portions 27*a*, 27*b* of the sleeve 27.

In a non-illustrated embodiment, the sleeve 27 is made in one piece (from one piece of material) with the connecting segment 19 of the central casing 6. In this case, each first portion and second portion of the sleeve 27 projects from a lateral flank 23 along the longitudinal axis X.

Advantageously, but without limitation, a protective sheath 34 is installed in the sleeve 27 and around the drive shaft 9. More specifically, the protective sheath 34 extends into the central bore 28 of the sleeve 27. The protective sheath 34 allows to guide the drive shaft 9 in rotation and prevents the friction between the various parts. In this example, the protective sheath 34 has a tubular shape coaxial with the longitudinal axis X.

In FIG. 2, the protective sheath 34 extends partly into the undercut 25 in the connecting elements 11. The protective sheath 34 has a cylindrical external surface which advantageously rests against a cylindrical internal surface of the first boss 24. The internal cylindrical surface delimits the undercut 25 in the connecting element 11. We understand that the diameter of the protective sheath 34 is substantially equal to or slightly smaller (by about 5 mm) than the internal diameter of the bearing surface.

As can be seen in FIG. 3, the protective sheath 34 is at a distance from the drive shaft 9 so as not to impede the rotation of the drive shaft 9. The protective sheath 34 is also arranged at a distance from an internal surface of the sleeve 27.

Advantageously, the protective sheath 34 is made of a metallic material. This material allows to make guiding easier. An example of a metallic material is steel. Other robust yet lightweight materials are also possible.

Figure 4:
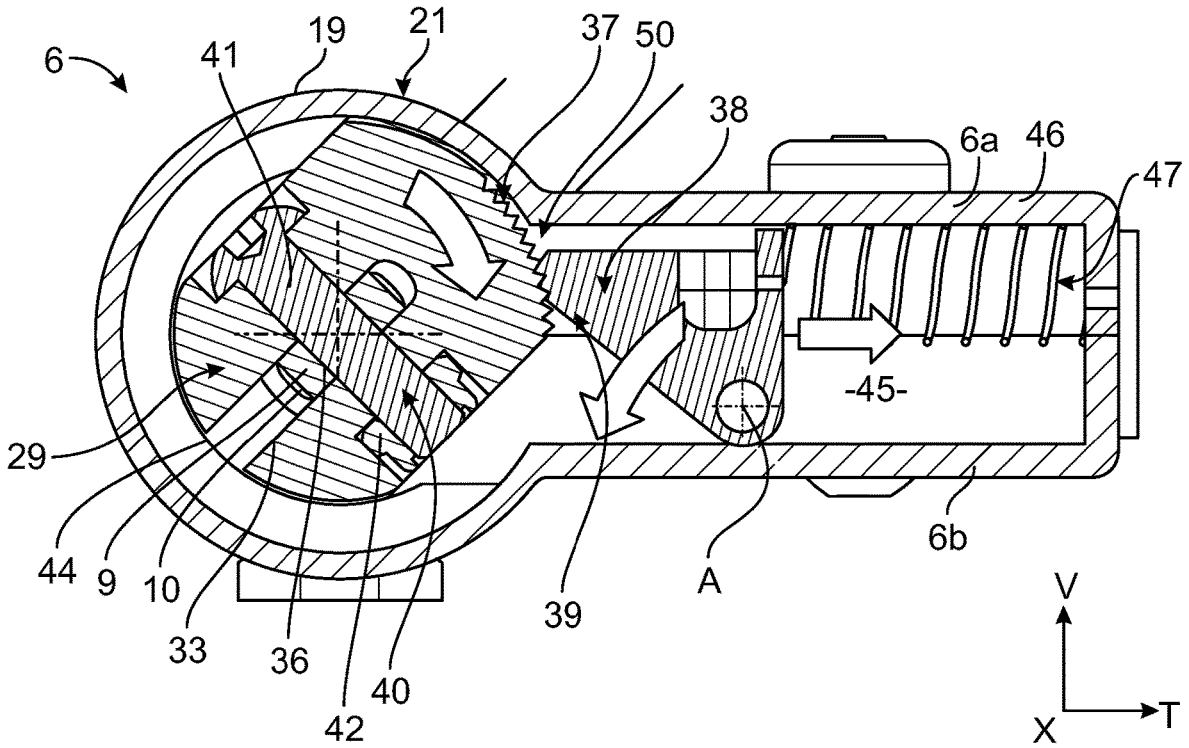
FIG. 4 is a cross-sectional view of a central casing housing a member of a connecting mechanism and a locking device in a first position according to another embodiment.
Figure 5:
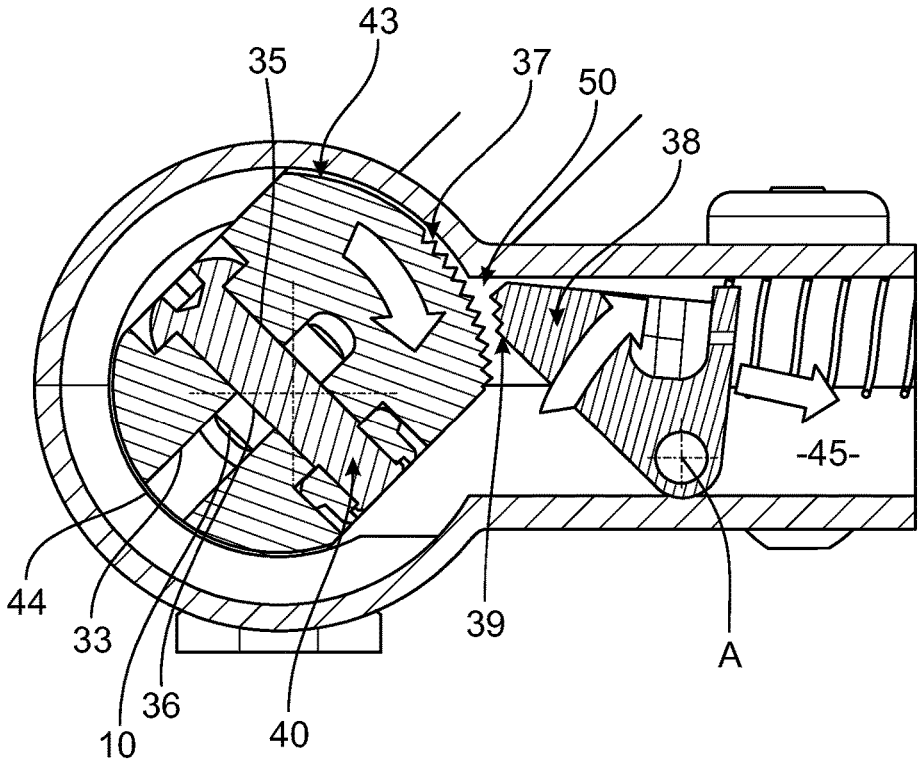
FIG. 5 shows the connecting mechanism member and the locking device in a second position as shown in FIG. 4.

With reference to FIGS. 4 and 5, the deckchair 1 comprises a locking device 50 configured to lock the deckchair 1 in the first position or in the second position. The locking device 50 can also be used to lock the position of the deckchair 1 in the intermediate position or positions.

Advantageously, the locking device 50 is housed in the central casing 6. This cooperates with the drive shaft 9.

To this end, the locking device 50 comprises a first element 29 which is secured in terms of movement to the drive shaft 9. In particular, the first element 29 is attached to the drive shaft 9 by means of attachment members 40. The attachment members comprise at least one screw 41 and one nut 42. In a variant embodiment illustrated in FIG. 2, the attachment members 40 comprise two screws 41, 41' which are screwed directly into thread holes provided in the first element 29. Other attachment members 40 are of course possible. In other words, the first element 29 is secured to the drive shaft 9 whatever the position of the deckchair.

As can be seen in FIGS. 4 and 5, the first element 29 comprises a longitudinal slit 33 which opens onto a peripheral external surface 43 of the first element 29. The drive shaft 9 can be inserted into this slit 33 so that the first element 29 at least partially surrounds the drive shaft 9. We understand that the first element 29 is passed through on either side by the drive shaft and that the first element 29 is located at the level of the median plane PM as shown in FIG. 2. In other words, the first element 29 is located in the middle of the drive shaft along its length. The first element 29 also comprises a cavity 35 which passes through the first element 29 on either side along an axis perpendicular to the longitudinal axis and in a plane perpendicular to the longitudinal axis. The cavity 35 opens into the slit 33 and also onto the external peripheral surface 43. The screw or screws 41 pass through the cavity 35 and the longitudinal slit 33 as well as the drive shaft 9. In other words, the drive shaft 9 comprises a through opening 36 on either side transversely. When installed, the through opening 36 is arranged facing the cavity 35. In this way, the first element 29 can perform a rotation at the same time as the drive shaft 9.

In one variant of embodiment, the cavity 35 is blind and has a thread hole for screwing in the screw or screws 41. The cavity 35 opens into the slit 33.

Advantageously, the first element 29 is installed in a recess 44 of the central casing 6, preferably at the level of the connecting segment 19. The recess 44 is passed through by the bore 10 of the central casing 6. Advantageously, but not restrictively, the recess 44 is in the shape of a circle coaxial with the bore 10. The diameter of the recess 44 is greater than the diameter of the bore 10. In addition, the first element 29 has a shape that matches that of the recess 44.

The first element 29 is substantially wheel-shaped, centred on the longitudinal axis.

The locking device 50 comprises a second element 38 movable between a locking position which locks the first element 29 and an unlocking position which unlocks the first movable element 29. The second element 38 is movable in rotation about an axis A parallel to the longitudinal axis X. Advantageously, the second element 38 is mounted on the central casing 6 by means of a pivot connection.

One of the first element 29 and second element 38 comprises at least one tooth configured to be housed in a corresponding slot in the other of the first element and second element so as to lock the drive shaft 9 in movement.

Advantageously, and according to the illustrated embodiment, the first element 29 is provided with first teeth 37 at least on a segment of the peripheral external surface. The space between two adjacent teeth forms a slot. The second element 29 comprises at least one second tooth 39 configured to engage with one of the first teeth 37 of the first element. In particular, the second tooth can be housed in a slot. In the example shown, the second element 38 comprises several second teeth 39. In other words, the second element 38 is configured so as to allow or prevent the movement of the first element 29.

Alternatively, the first element 29 could comprise a single first tooth 37 and the second element 38 could comprise a number of corresponding second teeth 39.

The shape of the teeth is designed so that the first element 29 and the second element 38 lock together automatically.

Advantageously, the second element 38 is installed in a chamber 45 of the central casing 6. The bore 10 (and the recess 44) opens into the chamber 45. The latter extends along an axis perpendicular to the longitudinal axis. Advantageously, the chamber 45 is arranged in an extension segment 46 of the central casing 6 which extends along the first transverse axis T. The extension segment 46 has a substantially parallelepiped shape. The extension segment 46 is coupled to the connecting segment 19. Advantageously, the central casing 6 is made from a single piece of material.

In this example of embodiment, the second element 38 is in the form of a cam. The latter is simple to manufacture and implement.

The locking device 50 also comprises a return element 47 arranged to exert a return force on the second movable element 38 towards the first movable element 29. The return element 47 is installed in the central casing 6. The return element 47 is in particular arranged in the chamber 45 and advantageously downstream of the second element 38, in this case the cam, with respect to the first transverse axis T. Advantageously, the return element 47 is a compression spring whose axis is parallel to the first transverse axis T.

Advantageously, the deckchair 1 comprises control elements 48 configured to control the locking device.

According to a first embodiment of the control elements 48, the latter comprise a handle 49 or control knob which is arranged on the seat structure and preferably on the longitudinal bar 5*c* as shown in FIG. 1. Alternatively, the handle 49 is located on the frame 2. In this case, the control elements 48 are at a distance from the locking device 50. The control elements 48 also comprise a cable (not shown) which is connected on the one hand to the handle 49 and on the other hand to the second element 38 (in this case the cam). The cable is advantageously mounted in a sheath 63 to protect it from external elements and extend its service life. When the handle 49 is actuated, the cable which connects this handle to the second element 38 allows the latter to be retracted, which then releases the movement of the first element 29 around the longitudinal axis. When the action on the handle ceases, the return element (spring) brings the teeth of the second element 38 back into engagement with the teeth of the first element 29. This prevents the drive shaft from rotating. We understand and as can be seen from the figures, that there is a single locking device housed in the central casing 6 and at the level of the median plane of the deckchair. This allows to simplify the locking device and its implementation in the deckchair, saving both time and money.

Figure 6:
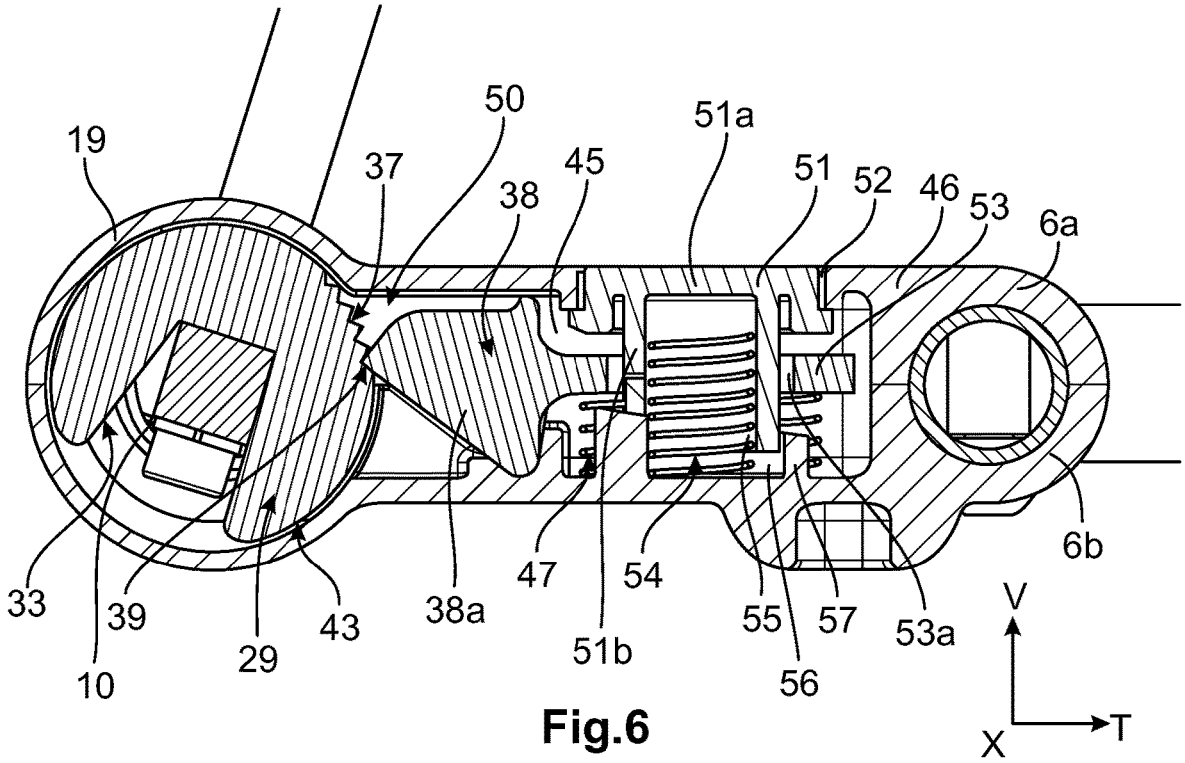
FIG. 6 illustrates another embodiment of a connecting mechanism and locking device in a first position.
Figure 7:
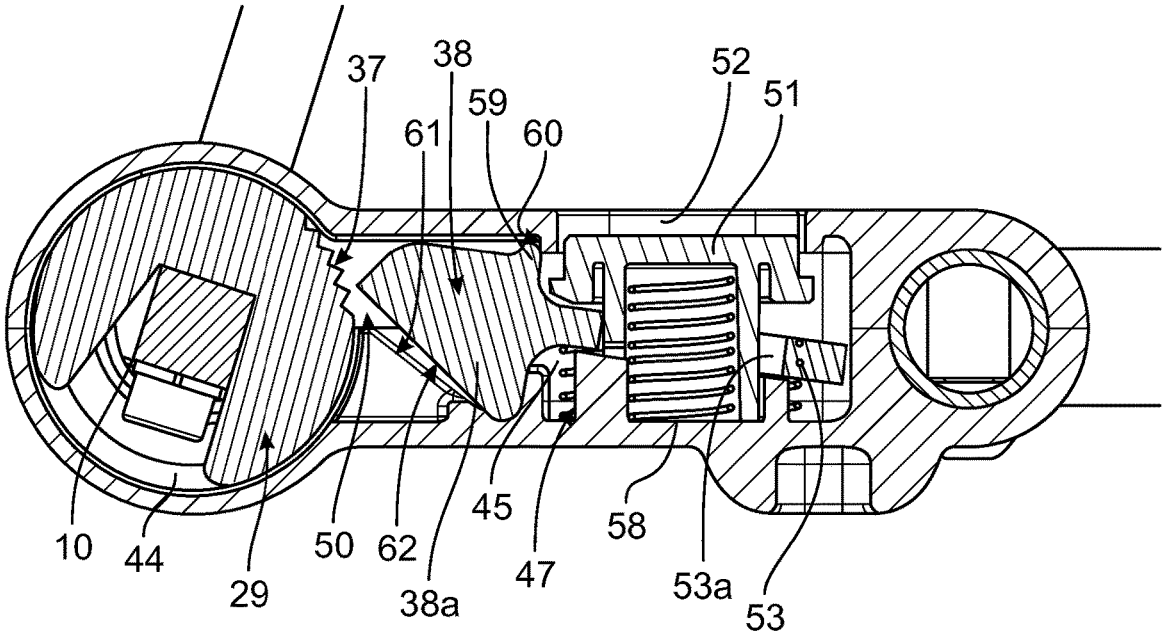
FIG. 7 shows the connecting mechanism member and the locking device in a second position as shown in FIG. 6.

FIGS. 6 and 7 illustrate a further embodiment of the locking device 50 and of the control elements 48. In particular, in this embodiment, the second element comprises a transverse leg 53 which extends from a head 38*a* (carrying the complementary tooth or teeth 32). The control elements 48 comprise a control knob 51 which is configured to actuate the return element 47 of the second element 38. A first return element 47, such as a compression spring, configured to exert a return force on the second element 38, has an axis defined in a plane perpendicular to the longitudinal axis (i.e. parallel to the second transverse axis V (which is vertical here with reference to FIGS. 6 and 7). In this case, the control knob 51 is provided in an orifice 52 with an axis parallel to the second transverse axis V. The orifice 52 opens into the chamber 45 of the central casing 6. The control knob 51 comprises a base 51*a* and a cylindrical rod 51*b* which extends along the second transverse axis V from the base 51*a*. Advantageously, the transverse leg 53 is arranged along the second transverse axis V between a segment of the control knob 51 (preferably the base 51*a*) and the first return element 47.

Advantageously, the transverse leg 53 comprises a through orifice 53*a* which passes through it on either side transversely and through which the cylindrical rod 51*b* passes. A second return element 54, such as a spring, is arranged inside a cavity 55 of the control knob 51. The cylindrical rod 51*b* comprises the cavity 55. This second return element 54 is also received in an indentation 56 arranged coaxially with the axis of the orifice 52 of the central casing 6. Advantageously, the indentation 56 extends along the second transverse axis V. This allows to hold the second return element 54 in place and guides the control knob 51. The indentation 56 is delimited by a peripheral wall 57 which extends from the base of the central casing 6 along the second transverse axis V. The first return element 47 is arranged around this peripheral wall 57. In other words, the first return element is arranged around the second return element.

Advantageously, end-of-travel stop means for the rotation of the second element 38 may be provided. A stop can be formed by the bottom 58 of the indentation 56 where a cylindrical wall of the control knob 51 comes in abutment. A further stop may be formed by a lip 59 which projects from an external peripheral surface of the second element 38. This lip 59 comes in abutment to a surface 60 of the central casing 6. Advantageously, the lip 59 is carried by the head 38*a* of the second element 38. The surface 60 is defined in a plane perpendicular to the first transverse axis T and is arranged in the chamber 45.

Advantageously, the central casing 6 comprises a resting surface 61 against which a surface segment 62 of the second element 38 abuts in the locking position. The surface segment 62 has a shape corresponding to that of the resting surface 61. The resting surface 61 is inclined at a predetermined angle with respect to the first transverse axis T. The predetermined angle can be between 35° and 55°.

When the control knob 51 is actuated, it presses on the first return element 47, which allows to retract the second element 38 and releases the movement of the first element 29 around the longitudinal axis. When the action on the control knob 51 ceases, the first return element 47 (the spring) brings at least the tooth of the second element 38 back into engagement with the teeth of the first element 29. This prevents the drive shaft 9 from rotating. The torque generated on the toothed wheel generates a force directed in a plane that forces the cam to butt up against the toothed wheel.

When the user wishes to fold the deckchair 1, he activates the control elements 48 which allow to unlock the locking device 50. With the second element 38 moved away from the first element 29, which is secured to the drive shaft 9, the user can tilt the uprights 5*a*, 5*b*, which drive the rotation of the drive shaft 9. By releasing the control elements 48, the user can lock the deckchair in the desired position.

The locking device 50 is effective and reliable because it does not allow the unlocking as long as a torque is applied to the first element 29.

The invention claimed is:

1. A foldable deckchair for a child comprising a frame configured to rest on a support surface, a seat structure configured to carry a flexible element for receiving the child, and a connecting mechanism for a connection between the frame and the seat structure which is configured to allow at least a movement of the frame relative to the seat structure, wherein the connecting mechanism comprises a drive shaft which extends along a longitudinal axis between a first end and a second end, and which is connected to two uprights of the seat structure at a level of the first and second ends, and a central casing, attached to the frame, which is passed through on either side by the drive shaft along the longitudinal axis, and in that the foldable deckchair comprises a single locking device which is housed in the central casing and at a level of a median plane of the foldable deckchair parallel to a direction of elongation of the foldable deckchair, the single locking device comprising a first element secured in movement to the drive shaft and a second element movable between a locking position in which the first element is locked and a unlocking position in which the first element is unlocked.

2. The foldable deckchair according to claim 1, wherein the second element is configured so as to allow or prevent the movement of the first element.

3. The foldable deckchair according to claim 1, wherein the first element is passed through on either a first side or a second side by the drive shaft along the longitudinal axis.

4. The foldable deckchair according to claim 1, wherein the first element is centred on the longitudinal axis and is provided with first teeth at least on a segment of its periphery, the second element being movable about an axis parallel to the longitudinal axis and comprising at least one second tooth configured to engage with one of the first teeth.

5. The foldable deckchair as claimed in claim 1, wherein the foldable deckchair further comprises a sleeve enveloping the drive shaft and extending on either a first side or a second side of the central casing along the longitudinal axis.

6. The foldable deckchair according to claim 5, wherein the foldable deckchair further comprises a protective sheath which is installed in the sleeve and around the drive shaft.

7. The foldable deckchair according to claim 5, characterised in that a return element is arranged in the central casing and so as to exert a return force on the second element movable towards the first element.

8. The foldable deckchair according to claim 5, wherein the sleeve comprises a first portion and a second portion which are separated by the central casing along the longitudinal axis, the central casing comprising a bore opening into a central bore of the sleeve.

9. The foldable deckchair according to claim 8, wherein the central casing comprises a connecting segment which comprises the bore, the connecting segment having a first external surface having a surface continuity with a second external surface of the sleeve.

10. The foldable deckchair according to claim 8, wherein a connecting element is mounted, at free end of an upright of the seat structure or at a distal end of the first portion and of the second portion of the sleeve, and wherein the connecting element includes a blind hole respectively receiving the first and second ends of the drive shaft.

11. The foldable deckchair according to claim 10, wherein the foldable deckchair further comprises control elements configured so as to control the single locking or unlocking of the single locking device.

12. The foldable deckchair according to claim 11, wherein the control elements are arranged so as to cause the second element to move between the locking position and the unlocking position.

* * * * *